US006805590B2

(12) United States Patent
Kato

(10) Patent No.: US 6,805,590 B2
(45) Date of Patent: Oct. 19, 2004

(54) MULTIPOLAR CONNECTOR

(75) Inventor: Hajime Kato, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/146,040

(22) Filed: May 16, 2002

(65) Prior Publication Data

US 2002/0173205 A1 Nov. 21, 2002

(30) Foreign Application Priority Data

May 17, 2001 (JP) ..... P2001-147891

(51) Int. Cl.[7] ..... H01R 25/00
(52) U.S. Cl. ..... 439/638; 439/752
(58) Field of Search ..... 439/638–9, 650–2, 439/752

(56) References Cited

U.S. PATENT DOCUMENTS 5,957,732 A * 9/1999 Ito et al. ..... 439/752
6,152,752 A * 11/2000 Fukuda ..... 439/275

FOREIGN PATENT DOCUMENTS

JP 11-219758 8/1999

* cited by examiner

*Primary Examiner*—Renee Luebke
(74) *Attorney, Agent, or Firm*—Sughrue Mion, PLLC

(57) ABSTRACT

A holder to be attached to a rear end of a connector housing (20) is constituted of a first holder and a second holder (22). The first holder is to be attached to the inside of the second holder (22). The second holder (22) is situated outside the first holder and attached to the connector housing (20) by means of second engagement sections (45) provided in locations differing from those of first engagement sections (26) of a first holder. The first holder and the second holder (22) has first and second shielding members for partitioning adjacent terminals from each other.

23 Claims, 6 Drawing Sheets

MULTIPOLAR CONNECTOR

BACKGROUND OF THE INVENTION

The present invention relates to a multipolar connector having a plurality of connection terminals, and more particularly, to a multipolar connector having a lock member for doubly locking a terminal connected to an electric wire.

As a related-art multipolar connector, a multipolar shielded connector described in, e.g., Japanese Patent Application Laid-Open No. 219758/1999, will be described with reference to FIGS. 9 and 10.

The multipolar shielded connector, designated by reference numeral 10, houses a plurality of terminal sections 2*a* of shielded electric wires 2, and terminals 3 connected to the terminal sections 2*a*. The multipolar shielded connector 10 has a connector housing 5 and a shielding member 7. A plurality of housing sections 4 are formed in the connector housing 5, and the terminals 3 are housed in the connector housing 5 along with the terminal sections 2*a*. The shielding member 7 collectively sheathes the plurality of housing sections 4 within the connector housing 5, thereby providing electromagnetical shielding from the outside of the terminal sections 2*a* of the electric wires 2 and the terminals 3 connected to the terminals sections 2*a*.

A holder 12 is engaged with an open rear end 11 of the connector housing 5.

The holder 12 is constituted by upper and lower half cover members 13, 14. Elastic engagement frames 16, each having an engagement hole 15, are formed in outer circumferential surfaces of the respective cover members 13, 14. The holder 12 is fastened to the opening section 11 of the connector housing 5 by means of causing the engagement holes 15 to engage with lock projections 17 provided on the outer periphery of the connector housing 5. Thus, a rubber plug 18 and a conducting block 19 are inhibited from coming out of the connector housing 5.

The conducting block 19 electrically connects a braided shield 2*b* of the shielded electric wires 2 to the shielding member 7. The shielded electric wires 2 pass through the rubber plug 18, thereby sealing the electric wires 2 and the connector housing 5 in a fluid-tight manner.

In the multipolar connector having the foregoing construction, the housing sections 4 house the terminals 3 and the terminal sections 2*a* and finally expand. In association with an increase in the number of poles, the connector housing 5 has become bulky, and simultaneously the multipolar connector has become bulky in the axial direction of the terminals 3.

The terminals 3 are doubly locked so as not to be able to come out of the connector housing 5, by means of unillustrated lock member for terminal locking purpose formed in the housing section 4 and the holder 12 fixed to the connector housing 5. The lock member provided in the housing section 4 cannot be applied to some terminal configurations. In this case, the terminals 3 are locked by simply the holder 12. However, locking of the terminals 3 with only the holder 12 may fail to provide connection reliability. For instance, if terminals connected to heavy-current wires are not doubly locked, a safety hazard may arise.

SUMMARY OF THE INVENTION

The present invention has been conceived in view of the foregoing circumstances and aims at providing a multipolar connector which has lock means for doubly locking terminals, ensures high connection reliability, and enables miniaturization of the connector.

In order to solve the aforesaid object, the invention is characterized by having the following arrangement.

(1) A multipolar connector comprising:

a connector housing for housing a high-current connection terminal connected to a wire and a low-current connection terminal connected to a wire;

a first holder, for preventing removal of the high-current connection terminal, including a first engagement section adapted to be engaged with the connector housing; and a second holder, for preventing removal of the low-current connection terminal and preventing removal of the high-current connection terminal, including a second engagement section which is adapted to be engaged with the connector housing at a position differing from that of the first engagement section.

(2) The multipolar connector according to (1), wherein the first holder includes a first shielding member projecting from an interior surface of the first holder and interposed between two adjacent high current connection terminals when the first holder is attached to the connector housing.

(3) The multipolar connector according to (2), wherein the first shielding member projects from a center portion of the interior surface of the first holder.

(4) The multipolar connector according to (1), wherein the second holder includes a plurality of second shielding members projecting from an interior surface of the second holder for housing a plurality of the low-current connection terminals therein, respectively.

(5) The multipolar connector according to (4), wherein the plurality of second shielding members are inserted into corresponding terminal housings provided in the connector housing when the second holder is attached to the connector housing.

(6) The multipolar connector according to (1), wherein the second holder covers the first holder to prevent the removal of the high-current connection terminal.

(7) The multipolar connector according to (1), wherein the first holder is interposed between the wire connected to the high-current connection terminal and the wire connected to the low-current connection terminal.

(8) The multipolar connector according to (1), wherein the first holder partially covers a surface of the connector housing, into which the high-current and low-current connection terminals are inserted, to allow insertion of the low-current connection terminal.

(9) The multipolar connector according to (8), wherein the second holder covers the first holder and the rest of the surface of the connector housing which is not covered by the first holder.

The first holder is individually attached to the first engagement section, and the second holder is also individually attached to second engagement section. Hence, the first and second holders possess independent terminal engaging forces. Hence, even when the lock means formed in the housing section cannot be applied to terminal geometries, the terminals can be doubly locked by the first and second holders.

Even when the connector housing has a structure in which the size of the connector housing is shortened in the axial direction and connection terminals are partially exposed by way of the rear end of the housing, the holders are arranged to come into contact with the connection terminals. Hence, the connection terminals can be locked so as not to be removed from the connector housing.

A housing can be miniaturized by means of application of the connector housing.

Even in the case of a connector structure in which connection terminals are partially exposed by way of a rear end of the housing, the first shielding member is arranged to as to partition adjacent connection terminals from each other, thereby inhibiting occurrence of contact between the terminals. The terminals are partitioned from each other without fail, and hence a multipolar connector can be miniaturized further by means of reducing the interval between adjacent terminals.

Even in the case of a connector structure in which connection terminals are partially exposed by way of a rear end of the housing, the second shielding member is arranged so as to partition them from each other, thereby inhibiting occurrence of a contact between the terminals.

Even when connection terminals have been incompletely inserted into the terminal housings, the second shielding member is inserted into the terminal housing and pushes the connection terminals when the second holder is attached to the housing, thereby inhibiting incomplete insertion of the connection terminals.

BRIEF DESCRIPTION OF DRAWINGS

FIGS. 8A through 8C show connection terminals to which the present invention is to be applied, wherein FIG. 8A shows a high-current connection terminal, FIG. 8B shows a first low-current connection terminal, and FIG. 8C is a perspective view of a second low-current connection terminal;

DETAILED DESCRIPTION OF PREFERRED EMBODIMENTS

A preferred embodiment of a multipolar connector according to the invention and that of a connection terminal applied to the multipolar connector according to the invention will be described hereinbelow by reference to the accompanying drawings.

Figure 1:
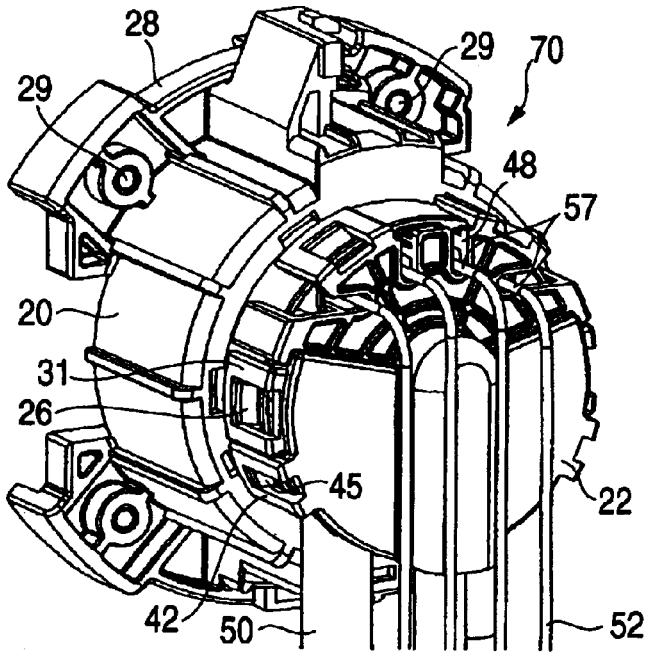
FIG. 1 is a perspective view of a multipolar connector according to an embodiment when viewed from a rear end thereof.
Figure 2:
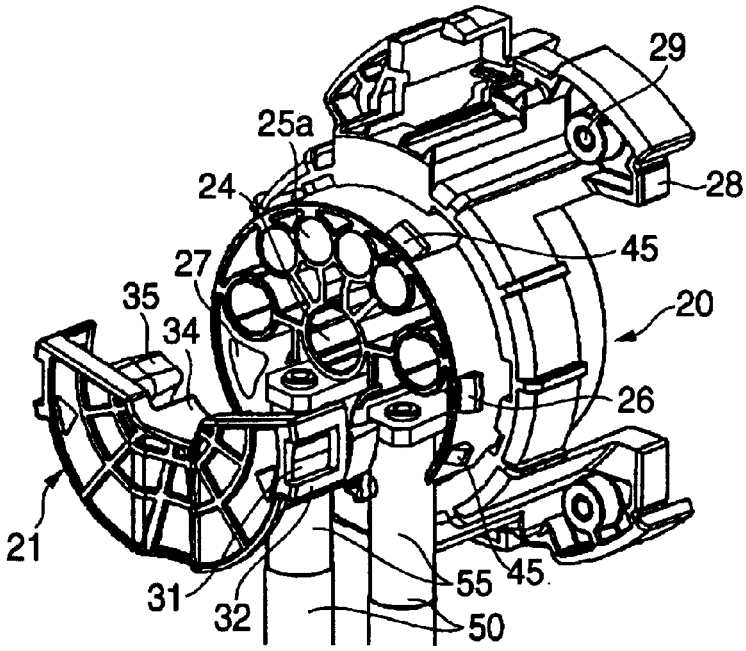
FIG. 2 is a perspective view of the multipolar connector shown in FIG. 1 before a first holder is attached to the connector.
Figure 3:
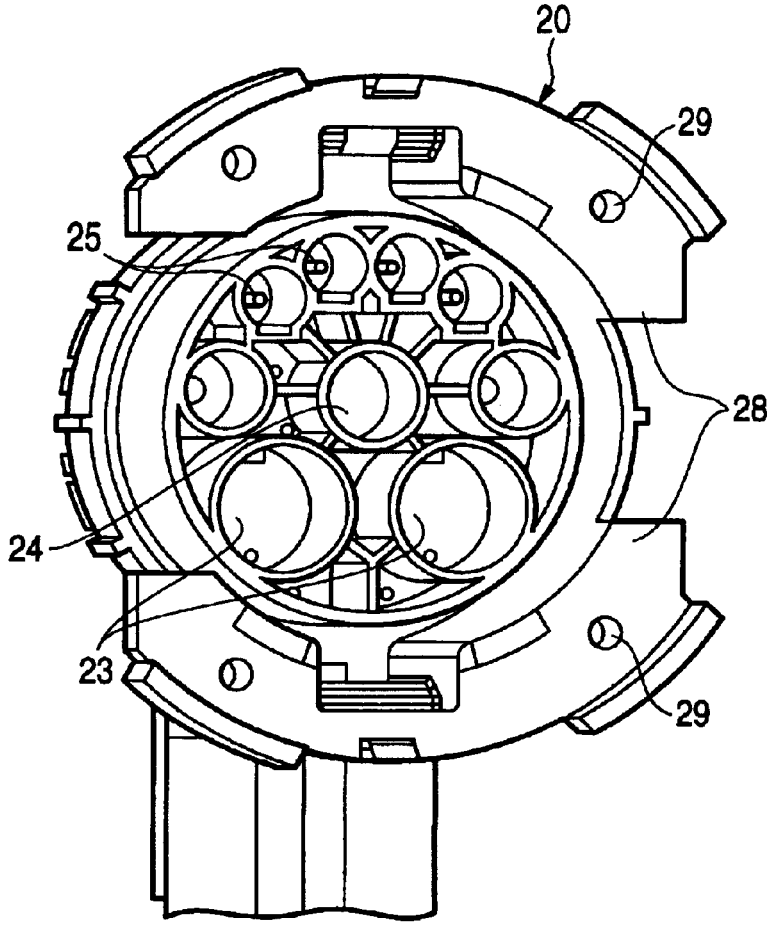
FIG. 3 is a perspective view of the multipolar connector shown in FIG. 1 when viewed from a front end thereof.
Figure 4:
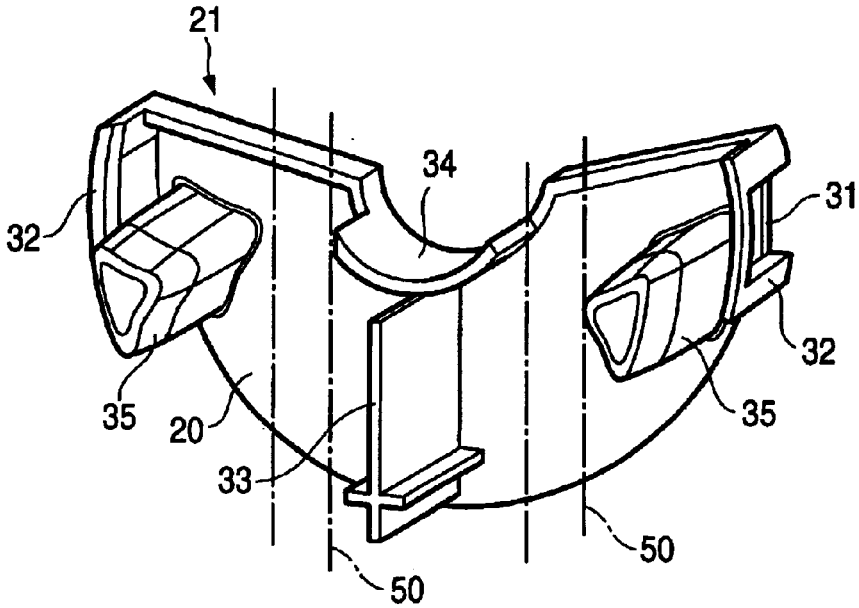
FIG. 4 is a perspective view of the first holder when viewed from the back thereof.
Figure 5:
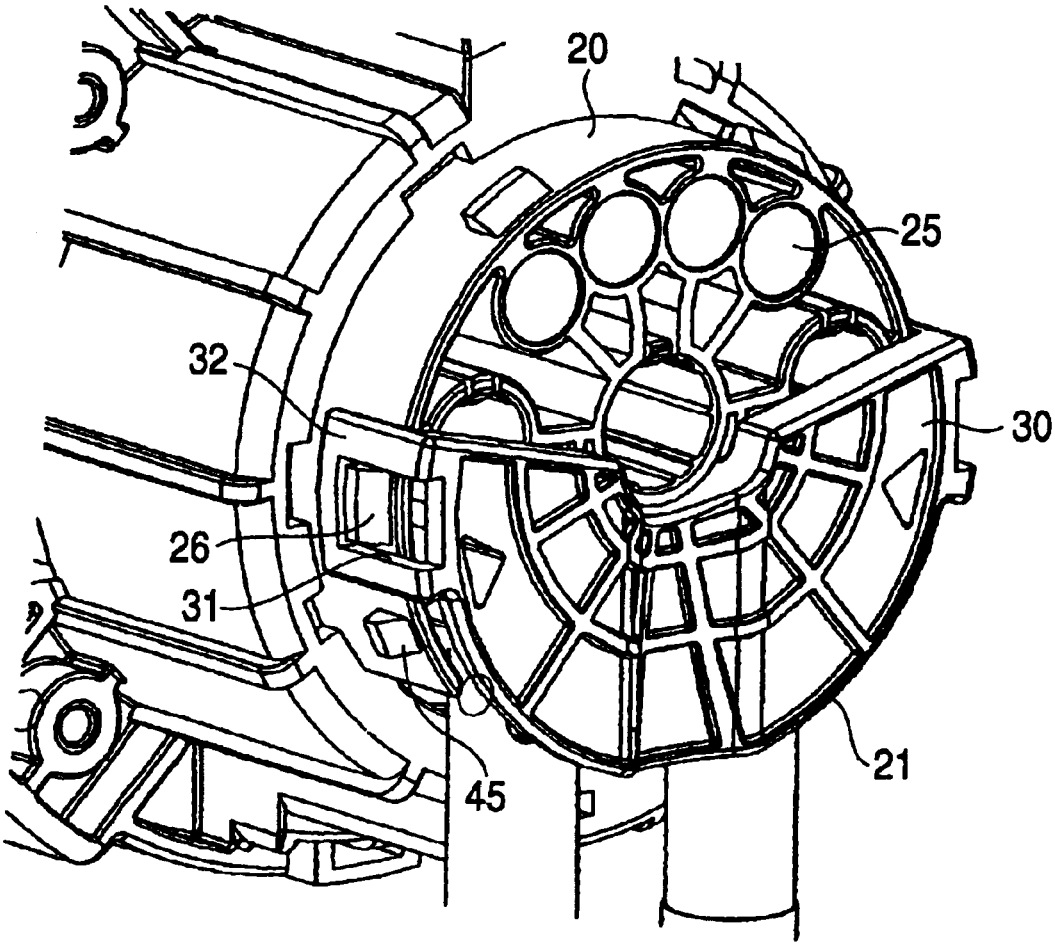
FIG. 5 is a perspective view of the multipolar connector after the first holder has been attached to the connector.
Figure 6:
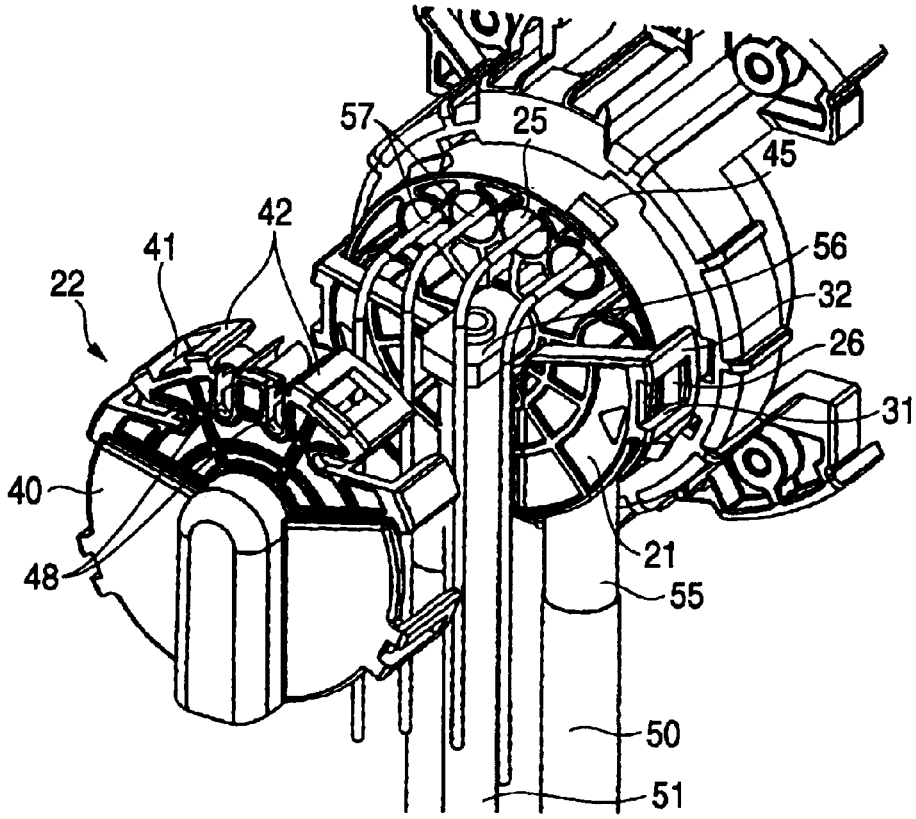
FIG. 6 is a perspective view of the multipolar connector before the second holder is attached to the connector.
Figure 7:
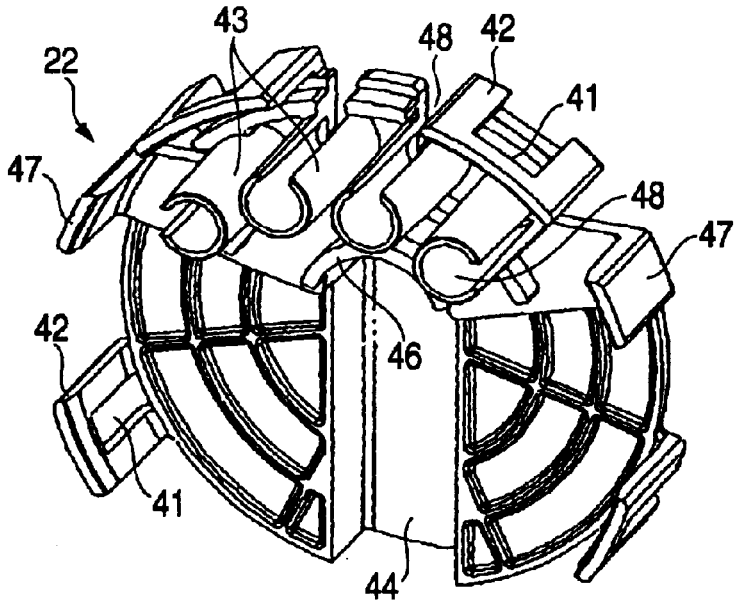
FIG. 7 is a perspective view of the second holder when viewed from the back thereof.
Figure 8A:
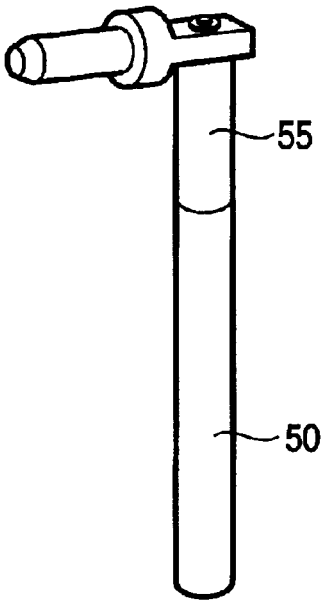
Figure 8B:
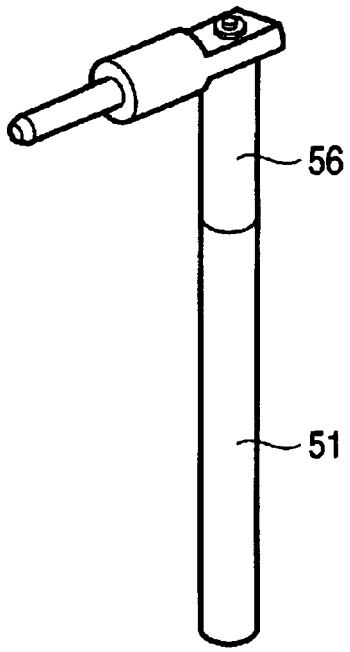
Figure 8C:
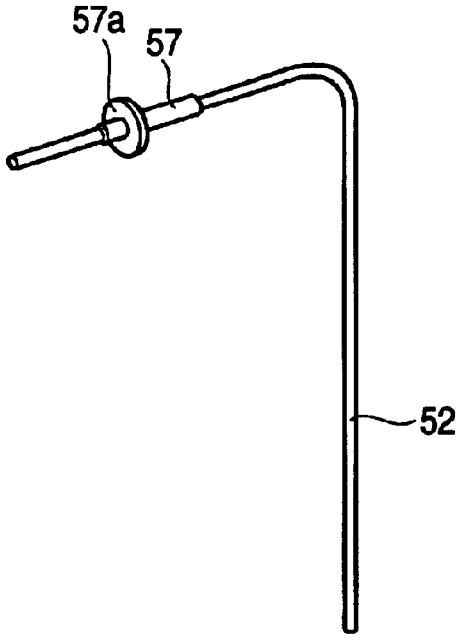
Figure 9:
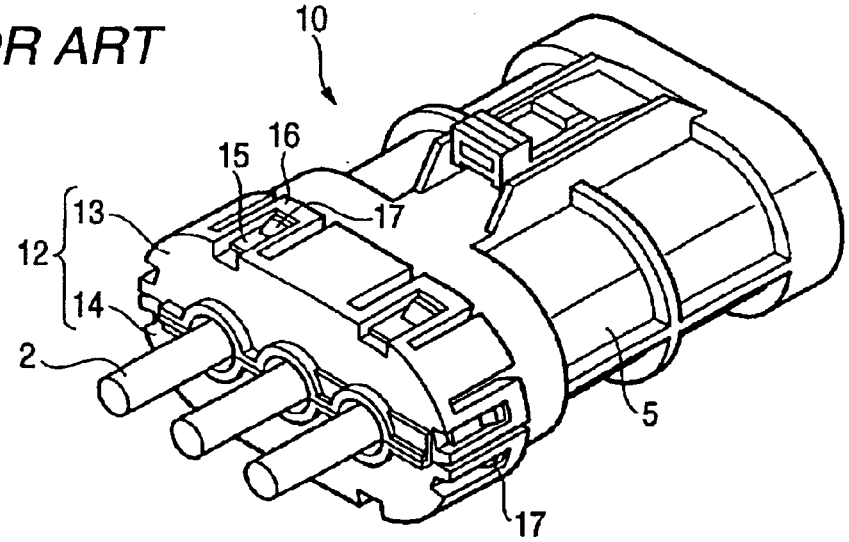
FIG.9 PRIOR ART
FIG. 9 is a perspective view of a related-art multipolar shield connector.
Figure 10:
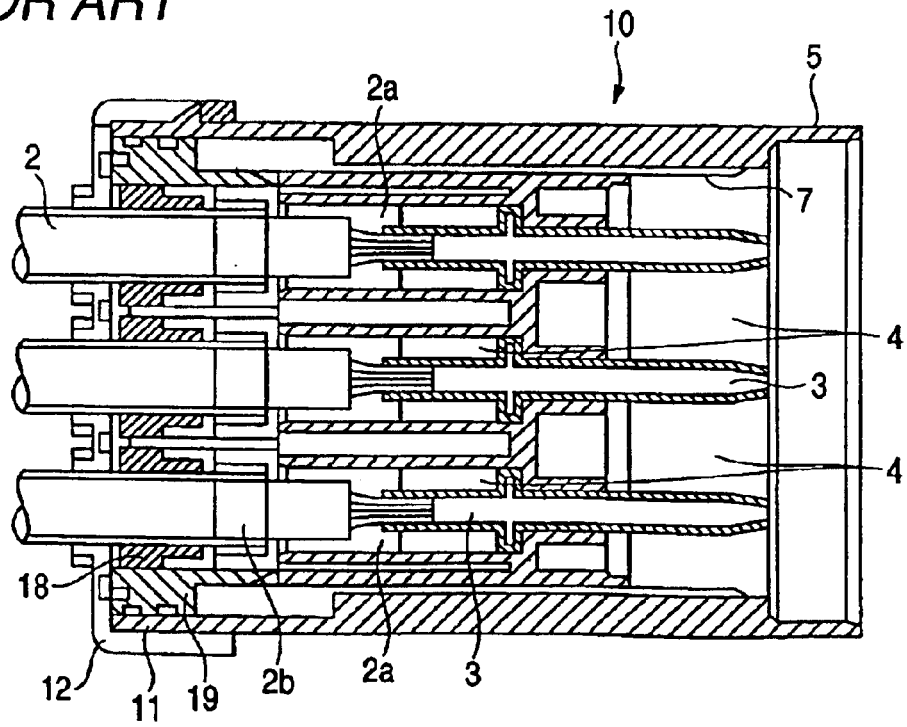
FIG.10 PRIOR ART
FIG. 10 is a longitudinal cross-sectional view of the related-art multipolar shield connector.

FIG. 1 is a perspective view of a multipolar connector according to an embodiment of the invention when viewed from a rear end thereof. FIG. 2 is a perspective view showing the multipolar connector shown in FIG. 1 before a first holder of the multipolar connector shown in FIG. 1 is attached thereto. FIG. 3 is a perspective view of the multipolar connector shown in FIG. 1 when viewed from the front end thereof. FIG. 4 is a perspective view of the first holder when viewed from the back thereof. FIG. 5 is a perspective view showing the first holder of the multipolar connector after the holder has been attached to the connector. FIG. 6 is a perspective view showing a second holder of the multipolar connector before the holder is attached to the connector. FIG. 7 is a perspective view of the second holder when viewed from the back thereof. FIGS. 8A through 8C are perspective views of a connection terminal, wherein FIG. 8A shows a high-current connection terminal; FIG. 8B shows a first low-current connection terminal; and FIG. 8C shows a second low-current connection terminal.

A multipolar connector 70 according to the embodiment is constituted substantially by a connector housing 20, and a first holder 21 and a second holder 22 which are to be attached to an open rear end of the connector housing 20.

As shown in FIGS. 2 and 3, the connector housing 20 is configured into a substantially cylindrical geometry. A pair of large-diameter, first terminal insertion holes 23, which act as terminal holding housings, are formed in a lower area of the circular surface of the connector housing 20. A medium-diameter, second terminal insertion hole 24, which acts as a terminal housing, is provided in the center of the connector housing 20. A plurality (four in this embodiment) of small-diameter, third terminal insertion holes 25, which act as terminal housings, are provided in an upper area of the circular surface.

A plurality of first engagement sections 26 and a plurality of second engagement sections 45 are provided in different positions on the outer peripheral surface in the vicinity of the rear end of the connector housing 20 so as to be spaced apart from each other in the circumferential direction. The first engagement sections 26 fixedly hold the first holder 21, and the second engagement sections 45 fixedly hold the second holder 22.

A flange-shaped fastening section 28 which comes into contact with a body panel of an unillustrated automobile is formed in the front end of the connector housing 20 so as to partially extend from the front end. A bolt insertion hole 29 to be used for inserting a bolt is formed in the fastening section 28.

As shown in FIGS. 4 and 5, the first holder 21 is constructed so as to comprise a substantially-semi-circular-plate-like main body 30, and a pair of engagement plates 32 provided continuously with the main body 30.

The pair of engagement plates 32 are formed such that portions of the circumferential edge of the main body 30 are extended and folded together in the same direction. An engagement hole 31 to be engaged with the first engagement section 26 of the connector housing 20 is formed in each of the engagement plates 32.

When the first holder 21 is attached to the connector housing 20 by means of engaging the engagement holes 31 with the first engagement sections 26, the main body 30 comes into contact with the terminals inserted into the large-diameter, first terminal insertion holes 23, thereby inhibiting removal of the terminals.

High-current connection terminals 55 shown in FIG. 8A are inserted into the large-diameter first terminal insertion holes 23.

A first shielding member 33 and a partition connected thereto are formed in the center of the interior surface of the main body 30 so as to protrude from the first holder 21, wherein the first shielding member 33 is interposed between a pair of the high-current terminals 55.

The partition 34 is constituted by an arcuate portion to be situated around the middle-size second terminal insertion hole 24, and linear portions extending radially outward from the arcuate portion. The partition 34 has two functions; that is, the function of separating the area of the large-diameter, first terminal insertion holes 23 from the area of the middle-size, second terminal insertion hole 24 and those of the small-diameter, third terminal insertion holes 25; and the function of regulating the mount height of the first holder 21.

Triangular cylindrical projection members 35 are formed so as to protrude from opposite sides on the interior surface of the main body 30 of the first holder 21.

As shown in FIGS. 6 and 7, the second holder 22 comprises a disk-shaped main body 40 and a plurality of engagement plates 42 continuously provided on the main body 40.

The plurality of engagement plates 42 are formed such that portions of the circumferential edge of the main body 40 are extended and folded together in the same direction. An engagement hole 41 to be engaged with the second engagement section 45 of the connector housing 20 is formed in each of the engagement plates 42.

In the second holder 22, a plurality of cylindrical, notched second shielding members 43 (four in the embodiment) are formed in an upper area on the interior surface of the main body 40.

The second shielding members 43 are formed so that they can be inserted into the small-diameter, third terminal insertion holes 25 formed in the connector housing 20, and notch grooves 48 are formed in the second shielding members 43 so as to extend to the main body 40.

An arcuate partition 46 and an indentation 44 connected thereto are formed on the interior surface of the main body 40. The arcuate partition is to be disposed around the middle-size, second terminal insertion hole 24 of the connector housing 20. The indentation 44 extends in a radial direction.

A pair of regulation walls 47, which are folded into the same shape as those of the engagement plates 42, are formed along the brim of the main body 40. The regulation wall 47 comes into contact with the connector housing 20, to thereby regulate the second holder 22 in a predetermined position.

When the second holder 22 is attached to the connector housing 20 by means of engaging the engagement holes 41 with the second engagement sections 45, the second shielding member 43 comes into contact with the terminals inserted into the small-diameter, third terminal insertion holes 25. Terminals which have been inserted incompletely into the connector housing 20 are inserted further, thereby inhibiting removal of the fully-inserted terminals.

The second holder 22 leads, to the outside by way of the indentation 44, the electric wires connected to the terminals inserted into the middle-size, second terminal insertion hole 24. Further, the second holder 22 leads, to the outside by way of the notched grooves 48 of the second shielding members 43, the electric wires connected to the terminals inserted into the small-size, third terminal insertion holes 25.

A first low-current connection terminal 56 shown in FIG. 8B is inserted into the middle-size, second terminal insertion hole 24. Second low-current connection terminals 57 shown in FIG. 8C are inserted into the small-diameter, third terminal insertion holes 25.

FIGS. 8A through 8C show the configurations of the connection terminals. FIG. 8A shows the high-current connection terminal 55, in which an electric wire 50 is inserted into and connected to one end of the L-shaped metal fixture by means of crimping. FIG. 8B shows the first small current connection terminal 56, in which an electric wire 51 is inserted into and connected to one end of an L-shaped metal fixture by means of crimping. FIG. 8C shows the second small-current connection terminal 57, in which a small-diameter electric wire 52 is inserted into and connected to one end of straight hardware by means of crimping.

Procedures for assembling the multipolar connector will now be described.

As shown in FIG. 2, while the high-current connection terminals 55 are inserted into the large-diameter, first terminal insertion holes 23, the first holder 21 is attached to the connector housing 20 such that the projection members 35 are fitted into fitting holes 27 formed in the housing 20 and such that the engagement plates 32 are engaged with the first engagement sections 26 of the connector housing 20.

At this time, the high-current connection terminals 55 and the electric wires 50 are extended downward and led to the outside by way of both ends of the partition 34 and along both sides of the first shielding member 44. In other words, the pair of high-current connection terminals 55 are electrically isolated from each other by means of the first shielding member 33. Accordingly, even when the high-current connection terminals 55 are disposed in proximity to each other as a result of an increase in packing density, no electrical connection or contact arises.

Here, the projection members 35 are guide members used for inserting the first holder 21 into the connector housing 20.

As shown in FIG. 6, the first low-current connection terminal 56 is inserted into the middle-size, second terminal insertion hole 24. The second low-current connection terminals 57 are inserted into the small-diameter, third terminal insertion holes 25. In this state, the second holder 22 is attached to the connector housing 20 from the outside of the first holder 21 while the second shielding members 43 are fitted into the third terminal insertion holes 25 and while the engagement plates 42 are engaged with the second engagement sections 45 of the connector housing 20.

At this time, the first low-current connection terminal 56 and the electric wire 51 are extended downward and led to the outside by way of the indentation 44. As shown in FIG. 1, the second low-current connection terminals 57 and the electric wires 52 are led to the outside by way of the notched grooves 48 of the second shielding member 43. In other words, the first low-current connection terminal 56 and the second low-current connection terminals 57 are electrically isolated from each other by means of the second shielding member 43 and the indentation 44. Accordingly, even when the first low-current connection terminal 56 and the second low-current connection terminals 57 are disposed in proximity to each other as a result of an increase in packing density, no electrical connection or contact arises.

As mentioned previously, as a result of the second shielding members 43 being fitted into the third terminal insertion holes 25, stops 57*a* of the incompletely-fitted second low-current connection terminals 57 are pressed, whereby the second low-current connection terminals 57 can be pushed into normal positions.

The embodiment has described the cylindrical connector housing and the circular holder. However, as a matter of course, the invention is not limited to the embodiment.

A mating connector housing can also be constructed in the same manner.

As mentioned previously, according to the present invention, a first holder attached to first engagement sections and a second holder attached to second engagement sections, the engagement sections being provided in different locations on a connector housing, possess independent terminal engaging forces. Hence, even when the lock means formed in the housing section cannot be applied to terminal geometries, the terminals can be doubly locked by the first and second holders.

Even when the connector housing has a structure in which the size of the connector housing is shortened in the axial direction and connection terminals are partially exposed by way of the rear end of the housing, the holders are arranged to come into contact with the connection terminals. Hence, the connection terminals can be locked so as not to be removed from the connector housing.

A housing can be miniaturized by means of application of the connector housing.

According to the present invention, the first holder has a first shielding member which is to be interposed between adjacent connection terminals when attached to the housing, thereby inhibiting occurrence of contact between the terminals. The terminals are partitioned from each other without fail, and hence a multipolar connector can be miniaturized by means of reducing the interval between adjacent terminals.

According to the present invention, the second holder has a second shielding member which is to be positioned so as to house connection terminals and partition them from each other when attached to the housing, thereby inhibiting occurrence of contact between the terminals.

According to the present invention, the second shielding member comes into contact with and pushes the connection terminals when the second holder is attached to the housing, thereby inhibiting dislodgment of the connection terminals from the connector housing or incomplete insertion of the connection terminals.

What is claimed is:

1. A multipolar connector comprising:

a high-current connection terminal connected to a high-current wire;

a low-current connection terminal connected to a low-current wire having a size different from the high-current wire;

a connector housing for housing the high-current connection terminal connected to the wire and the low-current connection terminal connected to the wire;

a first holder, for preventing removal of the high-current connection terminal, including a first engagement section adapted to be engaged with the connector housing; and a second holder, for preventing removal of the low-current connection terminal and preventing removal of the high-current connection terminal, including a second engagement section which is adapted to be engaged with the connector housing at a position differing from that of the first engagement section.

2. The multipolar connector according to claim 1, wherein the first holder includes a first shielding member projecting from an interior surface of the first holder and interposed between two adjacent high current connection terminals when the first holder is attached to the connector housing.

3. The multipolar connector according to claim 2, wherein the first shielding member projects from a center portion of the interior surface of the first holder.

4. The multipolar connector according to claim 1, wherein the second holder includes a plurality of second shielding members projecting from an interior surface of the second holder for housing a plurality of the low-current connection terminals therein, respectively.

5. The multipolar connector according to claim 4, wherein the plurality of second shielding members are inserted into corresponding terminal housings provided in the connector housing when the second holder is attached to the connector housing.

6. The multipolar connector according to claim 1, wherein the second holder covers the first holder to prevent the removal of the high-current connection terminal.

7. The multipolar connector according to claim 1, wherein the first holder is interposed between the wire connected to the high-current connection terminal and the wire connected to the low-current connection terminal.

8. The multipolar connector according to claim 1, wherein the first holder partially covers a surface of the connector housing, into which the high-current and low-current connection terminals are inserted, to allow insertion of the low-current connection terminal.

9. The multipolar connector according to claim 8, wherein the second holder covers the first holder and the rest of the surface of the connector housing which is not covered by the first holder.

10. The multipolar connector according to claim 1, wherein said connector housing is cylindrical in shape.

11. The multipolar connector according to claim 1, further comprising:

a plurality of first diameter high-current connection terminal insertion holes which act as terminal holding housings and are formed in a lower area of the connector housing.

12. The multipolar connector according to claim 11, further comprising:

a second diameter low-current connection terminal insertion hole which acts as a terminal housing and is provided in a center area of the connector housing, wherein said second diameter low-current connection terminal insertion hole is of a different size then said plurality of first diameter high-current connection terminal insertion holes.

13. The multipolar connector according to claim 12, further comprising:

a plurality of third diameter low-current connection terminal insertion holes which act as terminal housings and are provided in an upper area of the connector housing, wherein said third diameter low-current connection terminal insertion holes are of a different size from said second diameter low-current connection terminal insertion hole and said plurality of first diameter high-current connection terminal insertion holes.

14. The multipolar connector according to claim 1, wherein said first holder comprises a semi-circular-plate-like structure.

15. The multipolar connector according to claim 1, wherein said first engagement section of said first holder comprises a pair of engagement holes, wherein said engagement holes engage with a first engagement section of the connector housing.

16. The multipolar connector according to claim 1, wherein said first holder further comprises:

a partition which is arcuate in shape, wherein said partition separates a first diameter high-current connection terminal from a second diameter low-current connection terminal and a third-diameter low-current connection terminal, and wherein said partition regulates the mounting height of said first holder onto said connector housing.

17. The multipolar connector according to claim 1, wherein said first holder further comprises:

a plurality of triangular cylindrical projection members which protrude from opposite sides on an interior surface of the first holder.

18. The multipolar connector according to claim 1, wherein said second holder further comprises:

a disk-shaped structure; and a plurality of engagement plates continuously situated on a circumferential edge of said disk-shaped structure.

19. The multipolar connector according to claim 1, wherein said second holder further comprises:

a plurality of cylindrical notched second shielding members which are formed in an upper area on an interior surface of said second holder, wherein said plurality of cylindrical notched second shielding members are inserted into a third diameter low current connection terminal insertion hole in said connector housing, and a pair of regulation walls on a circumferential edge of said second holder which regulates said second holder in a predetermined position in relation to said connector housing.

20. The multipolar connector according to claim 1, wherein said high-current connection terminal and said low-current connection terminal are L-shaped.

21. The multipolar connector according to claim 1, further comprising:

the high-current connection terminal housed in said connector housing;

the first low-current connection terminal housed in said connector housing; and a second low-current connection terminal housed in said connector housing; wherein said second low-current connection terminal has a smaller diameter than the first low-current connection terminal.

22. A multipolar connector according to claim 1, wherein the high-current connection terminal has a diameter greater than the diameter of the low-current connection terminal.

23. A multipolar connector comprising:

a high-current connection terminal connected to a high-current wire;

a low-current connection terminal connected to a low-current wire having a size different from the high-current wire;

wherein the high-current connection terminal has a diameter greater than the diameter of the low-current connection terminal, a connector housing having a first portion for housing the high-current connection terminal connected to the high-current wire and a second portion for housing the low-current connection terminal connected to the low-current wire;

a first holder, for at least partially covering the first portion to prevent removal of the high-current connection terminal, including a first engagement section adapted to be engaged with the connector housing; and a second holder, for at least partially covering the second portion to prevent removal of the low-current connection terminal and preventing removal of the high-current connection terminal, including a second engagement section which is adapted to be engaged with the connector housing at a position differing from that of the first engagement section.

* * * * *